US007001230B2

(12) United States Patent
Saito

(10) Patent No.: US 7,001,230 B2
(45) Date of Patent: Feb. 21, 2006

(54) PISTON FOR TILT AND TRIM UNIT OF OUTBOARD DRIVE OF MARINE PROPULSION UNIT

(75) Inventor: Hideaki Saito, Kakegawa (JP)

(73) Assignee: Soqi Kabushiki Kaisha, Kakegawa (JP)

( * ) Notice: Subject to any disclaimer, the term of this patent is extended or adjusted under 35 U.S.C. 154(b) by 0 days.

(21) Appl. No.: 10/711,339

(22) Filed: Sep. 12, 2004

(65) Prior Publication Data

US 2005/0170714 A1 Aug. 4, 2005

(30) Foreign Application Priority Data

Oct. 22, 2003 (JP) ..... 2003-362544

(51) Int. Cl.
*B63H 5/125* (2006.01)

(52) U.S. Cl. ..... 440/61 R

(58) Field of Classification Search ..... 440/53, 440/55, 56, 61 R, 61 T
See application file for complete search history.

(56) References Cited

U.S. PATENT DOCUMENTS 5,980,339 A * 11/1999 Hartman et al. ..... 440/61 R
6,176,170 B1 * 1/2001 Uppgard et al. ..... 440/61 R
6,280,268 B1 * 8/2001 Nishi et al. ..... 440/61 R
6,309,264 B1 * 10/2001 Saito ..... 440/56

FOREIGN PATENT DOCUMENTS

JP 07-69289 3/1995

* cited by examiner

*Primary Examiner*—Lars A. Olson
(74) *Attorney, Agent, or Firm*—Ernest A Beutler

(57) ABSTRACT

A very effective unit for adjusting the condition of a marine propulsion device that is constructed in such a way to protect the various components from wear caused by foreign particles that may be formed during its life by trapping the particles in a cavity formed in an upper surface of an actuating piston.

14 Claims, 7 Drawing Sheets

PISTON FOR TILT AND TRIM UNIT OF OUTBOARD DRIVE OF MARINE PROPULSION UNIT

BACKGROUND OF INVENTION

This invention relates to a piston for the tilt and trim unit for a marine propulsion unit and more particularly to one that insures a long life particularly by preventing wear from foreign objects.

As is well known many marine propulsion systems, particularly ones having larger displacements employ hydraulically operated trim and tilt controls. These systems generally permit trim adjustment when the watercraft is in motion and tilting up out of the water for trailering or service. In addition they generally incorporate a pop up damping arrangement that permits the propulsion unit to pop up when an underwater obstacle is encountered to prevent damage and return to the trim adjusted position when it is cleared.

One such arrangement is shown in Published Japanese Application, publication number Hei 07-69289, published Mar. 14, 1995. As shown in that publication, the tilt and trim arrangement comprises a clamp bracket fixed to the watercraft hull and on which a propulsion unit is pivotally supported for the trim and tilt operation. This is accomplished by a tilt cylinder mounted with its axis extending in a generally vertical direction and capable of expanding and retracting in the axial direction. The lower end of the cylinder is pivotally supported by the clamp bracket through a lower pivot and its upper end is pivotally connected to the propulsion unit through an upper pivot. A pressurized oil control system for controlling oil delivery to accomplish the desired motion.

The tilt cylinder includes a cylinder body forming a large cylinder bore into which a large trim piston is fitted. A small cylinder bore is formed around the axis in a part of the cylinder body above the large cylinder bore with its upper end externally opened and its lower end communicating with the large cylinder bore. A cylinder tube with its upper end closed is fitted into and inserted through the small cylinder bore and connected to the large piston. A small piston is fitted into a separate cylinder bore in the cylinder tube. A piston rod is provided, which has an end extending upward from the small piston through the closure, is pivotally connected to the propulsion unit by the upper pivot.

However, when the trim cylinder is operated to expand/retract in order to adjust the trim position of the propulsion unit, the propulsion unit swings up and down as the piston repeatedly slides with respect to the inner peripheral surface of the cylinder bore through the sealing body with friction, as described above. The same occurs during repeated tilt up and down operations as well as popping up and return operations as occur when underwater obstacles are encountered and cleared. Therefore, extended and repeated use of the unit may often produce a minute foreign matter resulting from the wearing of the inner peripheral surface of the cylinder bore or the sealing body.

If this accumulated foreign matter becomes positioned between the inner peripheral surface of the cylinder bore and the sealing body sliding against the inner peripheral surface, as it frequently does, it may promote wear of engaging surfaces, thus deteriorating the seal between the inner peripheral surface of the cylinder bore and the piston. This obviously decreases the service life of the unit.

Therefore it is a principal object of the invention to provide a piston construction that improves the service life of a propulsion unit tilt and/or trim cylinder.

SUMMARY OF INVENTION

This invention is adapted to be embodied in a tilt and trim arrangement for an outboard drive supported for pivotal movement about an axis on a watercraft hull. The arrangement comprising a first unit fixed for pivotal movement relative to the hull and a second unit adapted to be connected to the outboard drive. One of the units comprises a body defining a cylinder bore and the other of the units comprises a piston reciprocating in the cylinder bore and dividing the cylinder bore into two axially spaced chambers. A piston rod is fixed to the piston and extending through one of the chambers for connection to the respective of the outboard drive and the hull. A cavity is formed in an uppermost surface of the piston and is spaced inwardly of its engagement with the cylinder bore for receiving foreign particles and precluding their entry to the mating surfaces of the piston and the cylinder bore.

DETAILED DESCRIPTION

Figure 1:
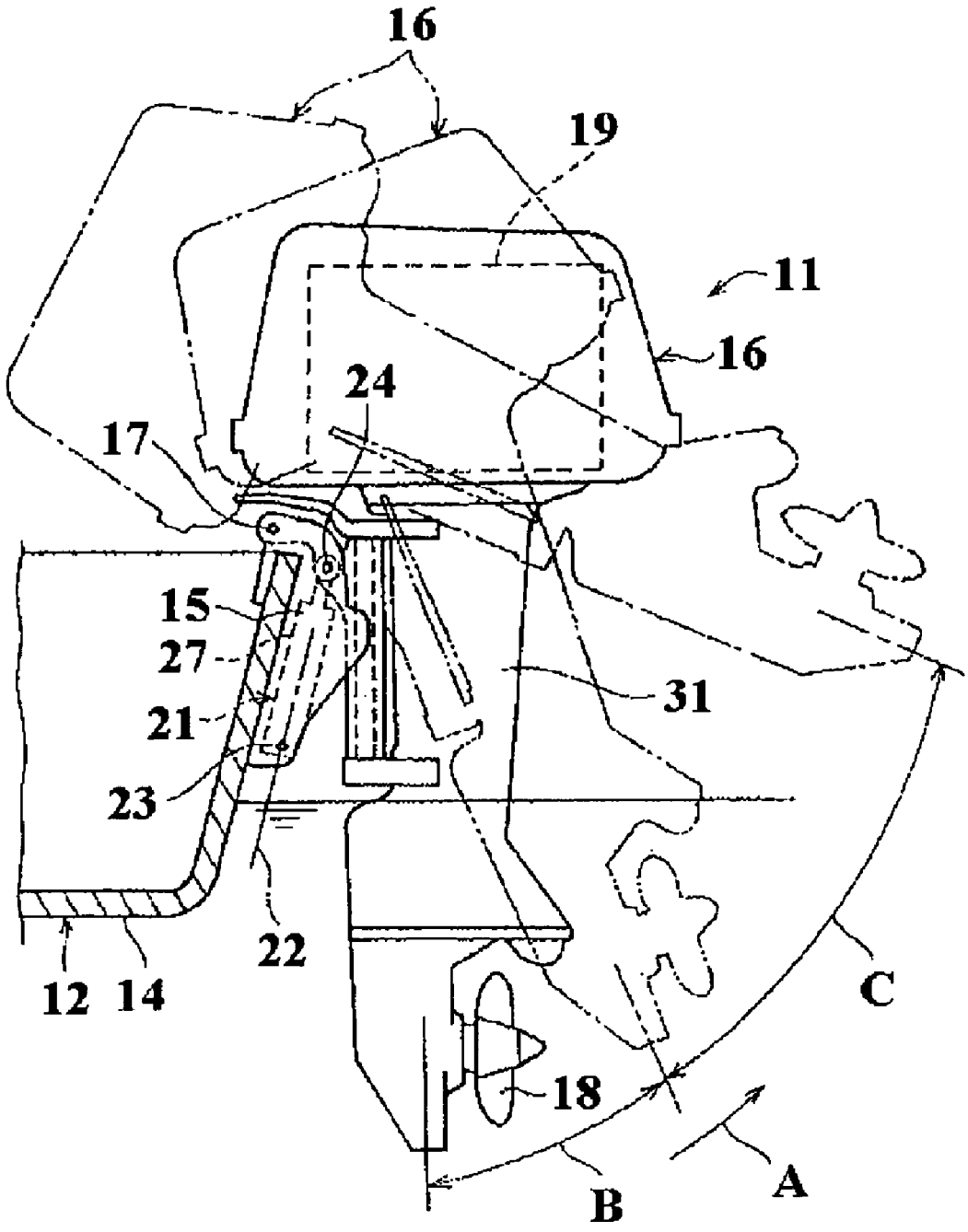
FIG. 1 is a side elevational view of a portion of a watercraft (shown partially and in cross section) with a propulsion unit attached utilizing a tilt and trim unit constructed in accordance with the invention, showing the range of trim and tilt movements in phantom lines.

Referring now in detail to the drawings and initially to FIG. 1, a watercraft propulsion unit in the form of an outboard motor 11 for propelling a watercraft such as a boat, indicated generally at 12, is supported on a transom 13 formed at a rear of a hull 14 of the boat 12. The outboard motor 11 includes, as part of its tilt and trim apparatus, a clamp bracket 15 removably mounted to the rear of the transom 13 of the hull 14 by means of fasteners (not shown).

As is well known in the art, the outboard motor 11 includes a propulsion unit, indicated generally at 16 provided at a rear of the clamp bracket 15 and pivotally supported by an upper part of the clamp bracket 15 by means of a pivot pin 17 to allow a propulsion device such as a propeller 18 at the lower part of the propulsion unit 16 to pivot in a manner to be described. The propeller 18 is driven in any desired manner such as by an internal combustion engine, indicated schematically at 19.

The upward pivotal movement from the fully tilted and trimmed down position shown in solid lines in FIG. 1 is rearward and upward in the direction of the arrow A in this figure through a trim range B and a fully tilted up range C. This movement is effected and controlled by a hydraulic tilt and trim cylinder constructed in accordance with the invention and indicated generally by the reference numeral 21. The tilt and trim cylinder is mounted with its axis 22, to be described in more detail later by reference to the remaining figures, extending in a generally vertical direction with its lower end pivotally supported by a lower part of the clamp bracket 15 by means of a lower pivot 23, as is well known in the art and in a specific manner to be described in more detail later.

A piston rod (to be identified in more detail later) of the tilt and trim cylinder assembly 21 has its upper end pivotally connected to the propulsion unit 16 by means of an upper pivot 24, in a manner as will also be described in more detail later. As will be described later, a pressurized oil control system controls delivery to/or exhaust from the chambers, to be described, of the tilt and trim cylinder 21 to operate the tilt and trim cylinder 21.

Figure 2:
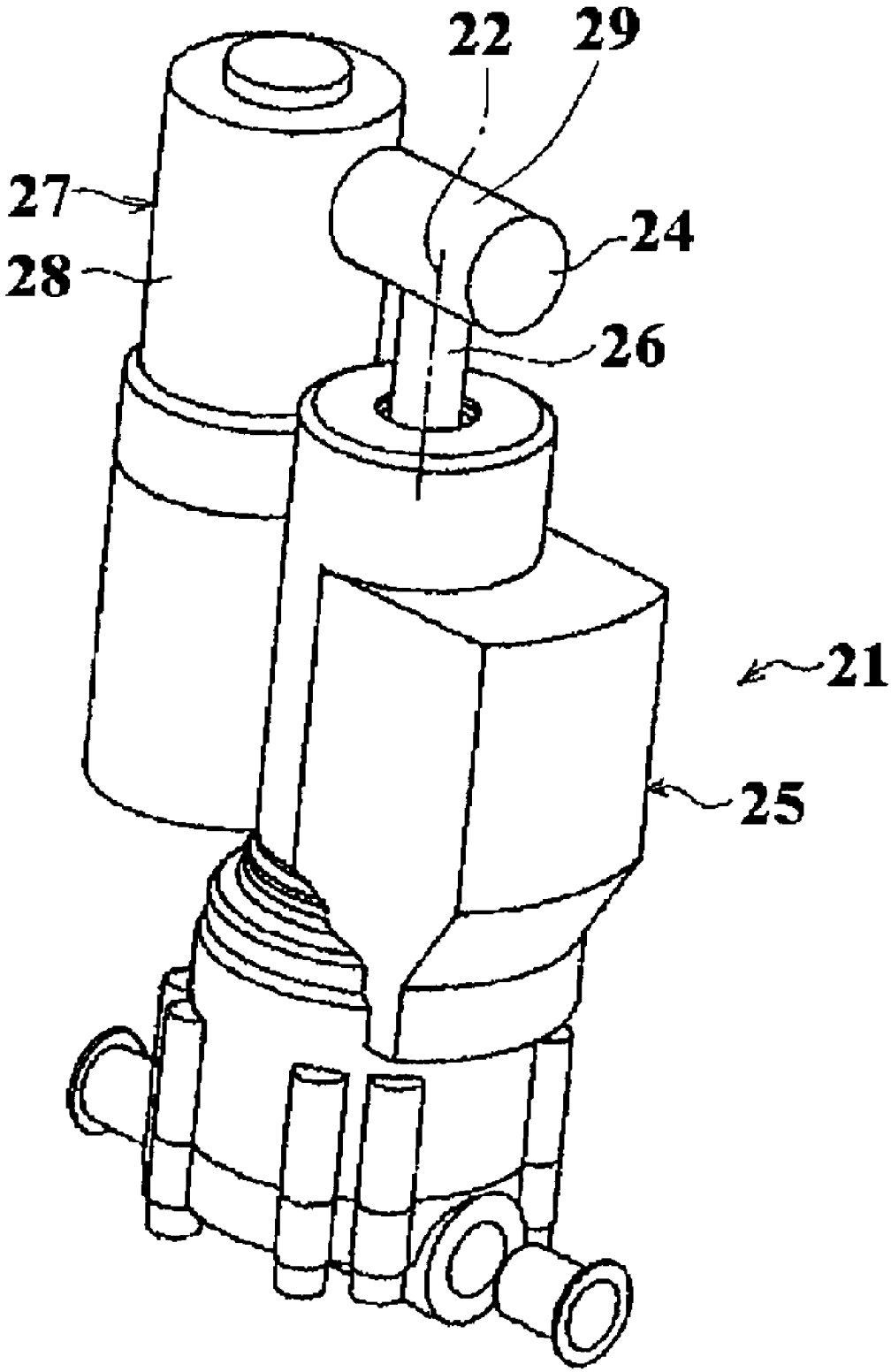
FIG. 2 is a perspective view of the trim and tilt unit.

Referring now to FIG. 2, this shows in perspective, the tilt and trim cylinder 21 that includes a cylinder body, indicated generally by the reference numeral 25, and from which the aforenoted piston rod 26 extends in a generally upward direction. Mounted to one side of the cylinder body 25 are some components of a hydraulic control system, indicated generally at 27. This system 27 includes a housing 28 that contains a reversible electric motor, for a purpose to be described.

As seen in this figure the upper pivot 24 is pivotally carried in a trunion 29 formed on the upper end of the piston rod 26. This upper pivot 24 has its opposite ends journalled in a manner to be described in a drive shaft housing 31 of the outboard motor 11 (see FIG. 1).

Figure 3:
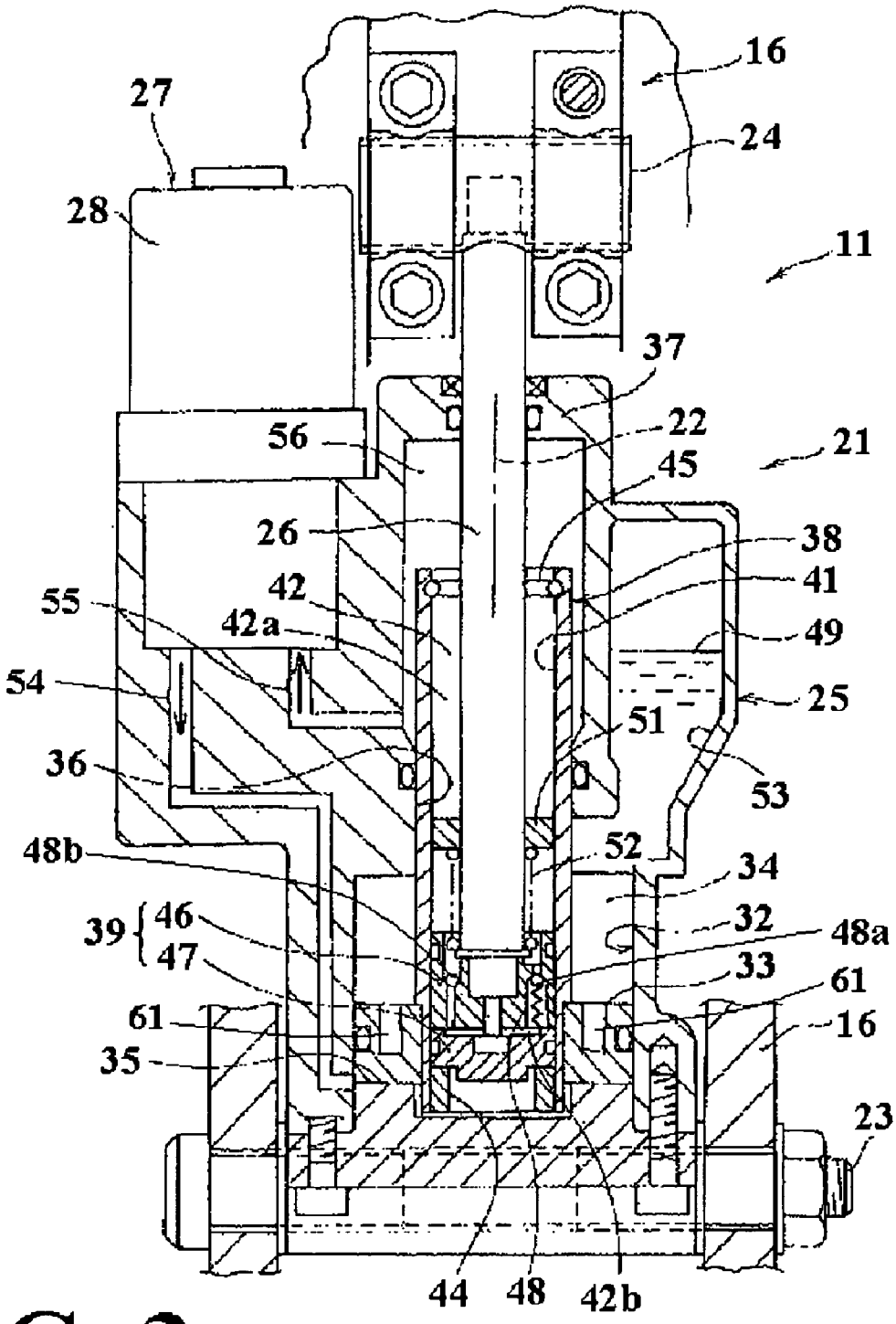
FIG. 3 is a cross sectional view of the tilt and trim unit taken through a transverse axis of the cylinder, showing the fully trimmed and tilted down position.
Figure 4:
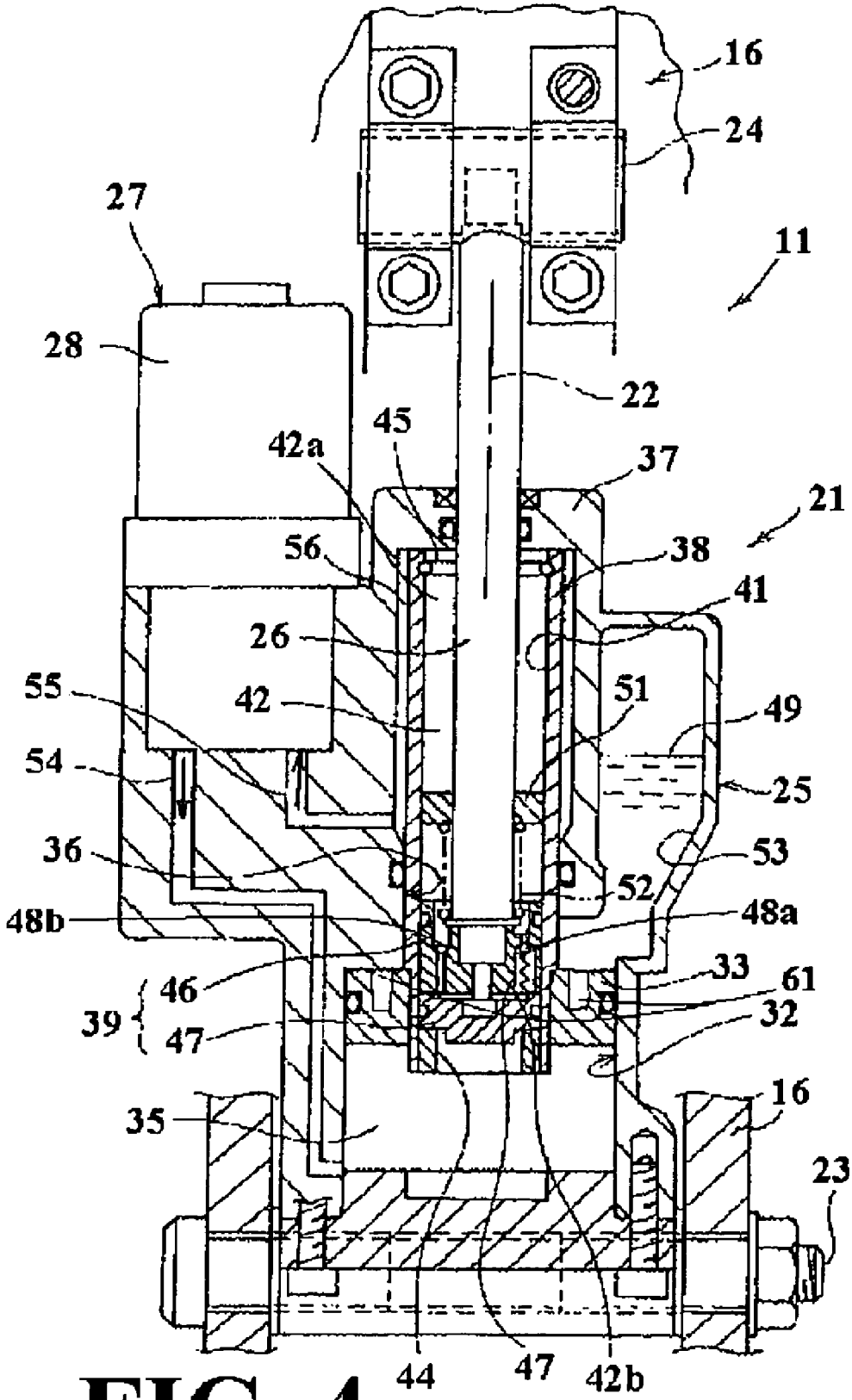
FIG. 4 is a cross sectional view, in part similar to FIG. 3, but showing the fully trimmed up position.
Figure 5:
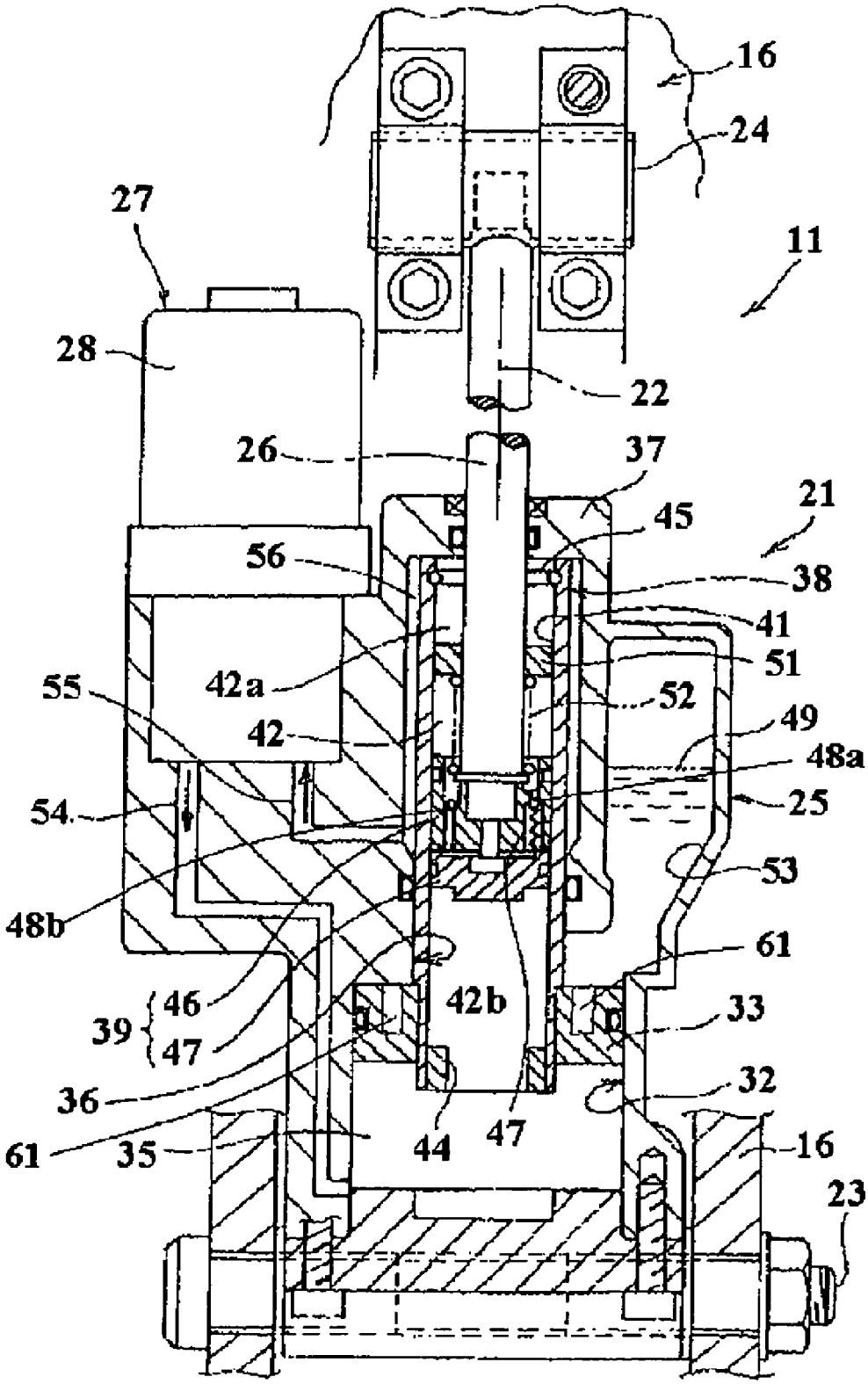
FIG. 5 is a cross sectional view, in part similar to FIGS. 3 and 4, but showing the fully tilted up position

Referring now to FIGS. 3–5 and as has already been noted, the tilt and trim cylinder 21 includes a cylinder body 25 that forms its outer shell and which is pivotally supported by the lower part of the clamp bracket 15 by means of the lower pivot 23. The cylinder body 25 has a larger diameter cylinder bore 32 formed around the axis 22, into which a large diameter piston 33 is fitted for reciprocation in the axial direction. The piston 33 divides the large cylinder bore 32 into an upper chamber 34 and a lower chamber 35.

A smaller diameter cylinder bore 36 is formed around the axis 22 in a part of the cylinder body 25 above the large cylinder bore 32 with its upper end closed by an integral end wall 37 of cylinder body 25 with its lower end communicating with an upper end of the large cylinder bore 32. A cylinder tube 38 is reciprocally fitted into the small cylinder bore 36 for movement in the axial direction and is fixed to the large piston 33. A small piston, indicated generally at 39, is supported for reciprocation in a smaller cylinder bore 41 formed in the cylinder tube 38. The small piston 39 divides the smaller cylinder bore 41 into upper and lower bore portions 42 and 43, respectively.

The piston rod 26 is fixed to and extends upward from the small piston 39 through the end wall 37 along the axis 22. The upper, exposed end of the piston rod 26, as has been noted, provides the pivotal connection to the propulsion unit 16 through the upper pivot 24.

A stopper ring 44 is fixed in the smaller cylinder bore 41 of the cylinder tube 38 to limit the downward movement of the small piston 39 In a like manner, an upper stopper ring 45 is provided to prevent the small piston 39 from moving up further than an upper predetermined position in the smaller cylinder bore 41.

The small piston 39 is comprised of upper and lower piston portions 46 and 47 that are each individually reciprocal in the smaller cylinder bore 41. The upper piston portion 46 divides the upper bore portion 42 of the smaller cylinder bore 41 into upper and lower areas 42*a* and 42*b*, respectively. The piston rod 26 extends upward from the upper piston portion 46 through both the lower bore area 42*b* and the upper bore area 42*a*. The stopper ring 45 prevents the upper piston portion 46 of the small piston 39 from moving up further than the predetermined position in the smaller cylinder bore 41.

A flow control, damping check valve 48 is disposed in a passage that extends vertically through the upper piston portion 46 for controlling the flow of oil, indicated by the reference numeral 49 between the upper and lower bore areas 42*a* and 42*b* of the upper bore portion 42. The flow control, damping check valve 48 includes a spring-loaded check valve element 48*a* for permitting only an oil 49 flow from the upper bore area 42*a* toward the lower bore area 42*b* of the upper bore portion 42 through a small hole for pop up damping purposes when an underwater obstacle is encountered.

An unbiased second, let down check valve 48*b* permits oil 49 to flow from the lower bore area 42*b* toward the upper bore area 42*a* through a separate small hole. This permits return from the popped up position when the underwater obstacle is cleared. In addition to permitting popping up of the drive when an underwater obstacle is encountered, the damping check valve resists popping up when operating in reverse.

In order to prevent direct metal to metal contact upon extreme pop up action and to cushion the stopping of such movement and as described in more detail in my related, co-pending application, Entitled "TILT AND TRIM SYSTEM OF OUTBOARD DRIVE OF PROPULSION UNIT", Ser. No. 10/711,337, filed concurrently herewith, an oil lock piston 51 is fitted into the upper bore area 42*a* of the upper bore portion 42 and normally disposed at a gap above the upper piston portion 46. A small annular gap is formed between the inner peripheral surface of the upper bore portion 42 and the outer peripheral surface of the oil lock piston 51 for permitting oil 49 to flow past the oil lock piston 51. This bypassed oil 49 can flow into a recess to be described shortly that is formed between the outer surface of the cylinder tube 38 and the housing 25.

If the oil lock piston 51 is tending to move up further than the upper predetermined position in the upper end in the upper bore portion 42 of the smaller cylinder bore 41, the oil lock piston 51 abuts directly with the stopper ring 45 and thus is prevented from moving up further. Since the oil lock piston 51 is thus prevented from moving up, the upper piston portion 46 is also prevented from moving up further.

As described more fully in my aforenoted co-pending application, a light cushion spring 52 with a low spring constant is interposed between the upper piston portion 46 and the oil lock piston 51 for elastically supporting the oil lock piston 51 above the upper piston portion 46. The cushioning spring 52 is received in recess 46*a* is formed in an upper surface of the upper piston portion 46 of the small piston 39 when the spring 52 is elastically contracted fully in a vertical direction. The receiving recess 46*a* may be formed in either of the upper piston portion 46 or the oil lock piston 51 or in both.

Still continuing to referring to FIGS. 3–5, the hydraulic control system 27 is contained within the housing 28 which is fixedly attached to the cylinder body 25. It includes a reversible hydraulic pump (not shown) driven, for example by the aforenoted reversible electric motor (also not shown) contained within the housing 28 for drawing, pressurizing and discharging oil 49 contained in an oil reservoir, shown schematically at 53, formed within the cylinder body 25 and which communicates with the upper chamber 34 of the large diameter cylinder bore 32.

As is well known in the art and as is described in more detail in my aforenoted co-pending application and also in my co-pending application entitled "TRIM SYSTEM FOR MARINE PROPULSION", Ser. No. 10/711,335, filed concurrently with this application, this hydraulic system operates to permit trim up from the fully trimmed down position shown here in FIG. 3, the fully trimmed up position shown here in FIG. 4 at a low speed but with a high force due to the large diameter of the piston 33 and then, if desired, to a fully tilted up position as shown herein in FIG. 5 at a greater speed due to the smaller diameter of the piston assembly 39. This difference in force and speed is desired because the trim operation is normally done when operating the associated watercraft in a forward direction but the tilt up operation is done when in a stationary position.

The direction of flow during trim and tilt up operation is indicated by the arrows in these figures showing the pressure flow from the pump through a passage or conduit 54 formed in the cylinder body 25 and communicating with the lower large chamber portion 25. Fluid is returned to the reservoir 53 from both the direct communication of the upper chamber portion 34 with the reservoir 53 or through a second passage or conduit 55 that communicates with the aforenoted recess around the upper portion of the cylinder tube 38 that is indicated by the reference numeral 56 in the direction of the arrow.

Reverse operations from the fully tilted up position through a range of trim down positions is obtained by operating the pump in the opposite direction to reverse the flow between the respective chambers as is well known to those in the art and as described in more detail in the two noted co-pending applications the disclosure of which is incorporated herein by reference. However when this is done the flow through the passages 54 and 55 is reversed from the arrows shown in FIGS. 3–5.

As is also noted in the aforenoted co-pending applications, the system operates to permit popping up from any set trim position is permitted when an underwater obstacle is encountered, how the popping up action is damped to a stop and the propulsion unit 16 can return to the trim adjusted position when the obstacle is cleared. This popping up and associated damping at the end of travel works from any trim adjusted position, as is also described in those co-pending applications and for that reason further discussion thereof is not believed necessary for those skilled in the art to understand the invention hereof.

The tilt cylinder 21 includes a sealing body in the form of an elastic O-ring 57 mounted in a groove in the outer peripheral surface of the large piston 33 for sealing between the inner peripheral surface of the large cylinder bore 32 and the outer peripheral surface of the large piston 33. In a like manner a sealing body of an elastic O-ring 58 is mounted in a groove in the inner peripheral surface of the small cylinder bore 36 for sealing between the inner peripheral surface of the small cylinder bore 36 and the outer peripheral surface of the cylinder tube 38. Finally a sealing body in the form of a further O-ring 59 is mounted in a groove in an outer peripheral surface of the small piston 28 for sealing between the inner peripheral surface of the separate cylinder bore 27 and the outer peripheral surface of the small piston 28. The O-rings are 57, 58, and 59 are formed from a suitable elastic such as rubber.

Figure 7:
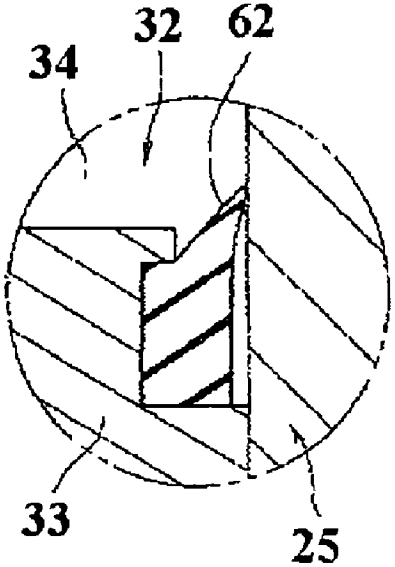
FIG. 7 is a further enlarged view of the area encompassed by the circle 7 in FIG. 6.
Figure 6:
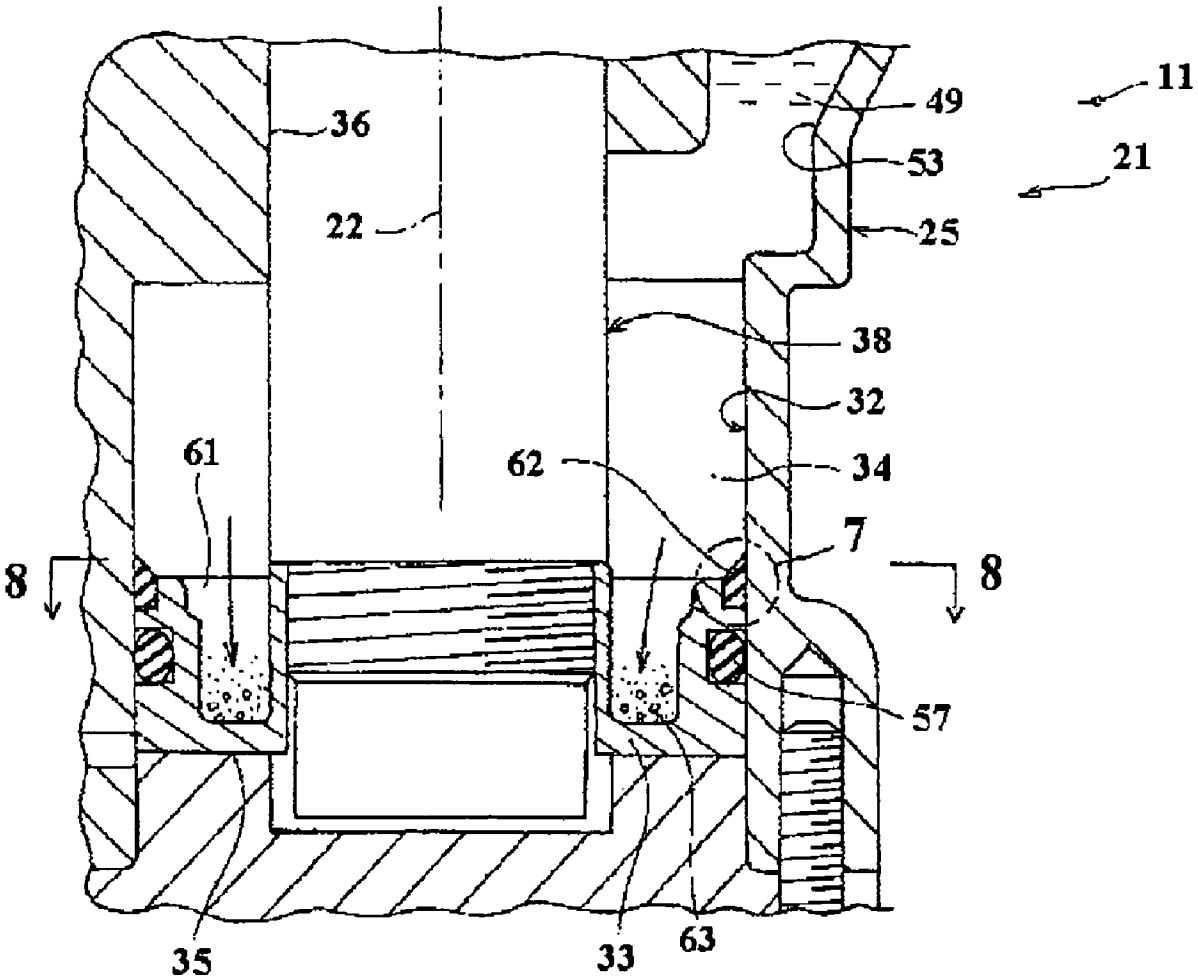
FIG. 6 is an enlarged cross sectional view, in part similar to FIG. 3 but shows the detailed construction of the trim piston.
Figure 8:
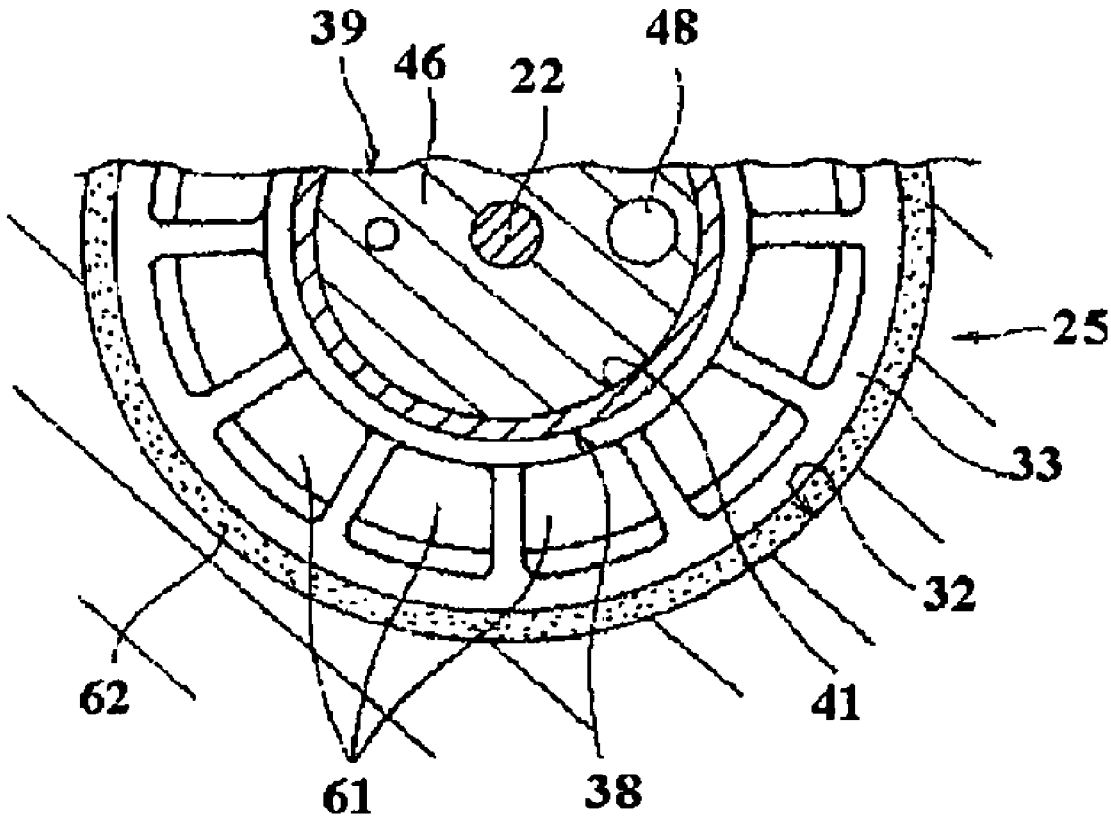
FIG. 8 is a cross sectional view taken along the line 8—8 of FIG. 6.

Referring now primarily to FIGS. 6–8, continued reciprocation of both the trim piston 33 in its bore 32 and the tilt piston assembly 39 in its bore 36 will cause small particles to form, as aforenoted, which if left free will lodge between the pistons 33 and 39 and their respective bores 32 and 36. To avoid this and the resulting wear that would occur, a plurality (twelve) of recess 61 each having a bottom and opening on an upper side is formed on an upper surface of the large piston 33. The recesses 61 are of the same shape and size are provided around the axis 22 at equal circumferential spacing.

The area around the recesses 61 is sealed by an annular elastic sealing lip 62 made of rubber is attached to an upper end of a radially outer edge of the large piston 33 around the axis 22. The peripheral portion of the sealing lip 62 projects upward from the upper end of the outer edge of the large piston 33 such that the peripheral portion expands axially outward toward its projecting end which is elastically pressed against the inner peripheral surface of the large cylinder bore 32.

When the tilt and trim cylinder 21 is repeatedly expanded/retracted to change the trim condition of the propulsion unit 16 by delivering oil 49 into the large cylinder bore 32 of the tilt and trim cylinder 21 and causing the large piston 33 to slide against the inner peripheral surface of the large cylinder bore 32, a minute foreign particles shown in enlarged form and indicated by the reference numeral 48 in FIG. 6 may be produced, resulting from wearing or abrasion due to the sliding movement.

In this case, such foreign matter 48 produced in the upper chamber portion 34, of the upper and lower bores 63 and 32 of the large cylinder bore 32, sinks in the oil 49 in the upper chamber portion 34 owing to its own weight and is received at the bottom of the recess 61. Therefore, the foreign matter 48 is prevented from moving freely in the oil 49 where it could become trapped between the inner peripheral surface of the large cylinder bore 32 and the large piston. Thus, the inner peripheral surface of the large cylinder bore 32, the large piston 33, and the sealing body 57 are protected from further wear by the foreign matter 48, and the life of the seal between the inner peripheral surface of the large cylinder bore 32 and the large piston 33 is lengthened, thereby improving the service life of the tilt and trim cylinder 21.

Since the oil 49 is circulated continuously through the reservoir 53 during the tilt and trim operations as well as when popping up, any foreign particles 63 formed on either side of the tilt piston assembly 39 or in the lower chamber portion 35 of the large cylinder bore 32 will eventually be delivered to the upper chamber portion 34 and trapped in the recesses 61. Also and as described previously, the annular sealing lip 62 prevented the foreign particles 63 from moving toward a space between the inner peripheral surface of the large cylinder bore 32 and the outer peripheral surface of the large piston 33. The entrapped foreign particles 63 can be removed from the recesses 61 at times when the tilt and trim cylinder 21 is normally opened for servicing.

Thus from the foregoing description it should be readily apparent that the described embodiment provides a very effective tilt and trim unit that is constructed in such a way to protect the various components from wear caused by foreign particles that may be formed during its life. Of course those skilled in the art will readily understand that the described embodiments are only exemplary of forms that the invention may take and that various changes and modifications may be made without departing from the spirit and scope of the invention, as defined by the appended claims. For examples only, the stopper ring 44 may be formed integrally with the cylinder tube 38 and/or the plurality of recesses 61 may be replaced with a single annular recess provided around the axis 22. Also, the cross section of the recesses 61 may be a dovetail shape with a larger bottom width.

What is claimed is:

1. A position adjusting arrangement for an outboard drive supported for pivotal movement about an axis on a watercraft hull, said arrangement comprising a first unit fixed for pivotal movement relative to the hull and a second unit adapted to be connected to the outboard drive, one of said units comprising a body defining a cylinder bore, the other of said units comprising a piston reciprocating in said cylinder bore and dividing said cylinder bore into two axially spaced chambers and a piston rod fixed to said piston and extending through one of said chambers for connection to the respective of the outboard drive and the hull, and a cavity formed in an uppermost surface of said piston spaced inwardly of its engagement with said cylinder bore for receiving foreign particles and precluding their entry to the mating surfaces of said piston and said cylinder bore, and an annular sealing ring positioned at the uppermost surface of the piston above said cavity.

2. A position adjusting arrangement as set forth in claim 1 wherein the annular sealing ring has a lip formed at its upper edge held in sliding relation to the cylinder bore.

3. A position adjusting arrangement for an outboard drive supported for pivotal movement about an axis on a watercraft hull, said arrangement comprising a first unit fixed for pivotal movement relative to the hull and a second unit adapted to be connected to the outboard drive, one of said units comprising a body defining a cylinder bore, the other of said units comprising a piston reciprocating in said cylinder bore and dividing said cylinder bore into two axially spaced chambers and a piston rod fixed to said piston and extending through one of said chambers for connection to the respective of the outboard drive and the hull, and a closed bottom cavity formed in an uppermost surface of said piston spaced inwardly of its engagement with said cylinder bore for receiving and entrapping foreign particles and precluding their entry to the mating surfaces of said piston and said cylinder bore.

4. A position adjusting arrangement as set forth in claim 3 wherein the cavity extends around the circumference of the piston.

5. A position adjusting arrangement as set forth in claim 4 wherein the cavity comprises a plurality of circumferentially spaced recesses.

6. A position adjusting arrangement as set forth in claim 1 wherein a circulating system including a reservoir circulates fluid between the reservoir and chambers formed above and below the piston for accumulating particles formed either above or below the piston into the cavity.

7. A position adjusting arrangement as set forth in claim 6 wherein the piston effects movement of the outboard drive through a plurality of trim adjusted positions.

8. A position adjusting arrangement as set forth in claim 7 wherein the arrangement also includes a tilt piston received in a tilt cylinder bore and connected to the outboard drive from a fully trimmed up position to a tilted up out of the water position.

9. A position adjusting arrangement as set forth in claim 8 wherein the circulating system also operates the tilt piston within the tilt cylinder bore.

10. A position adjusting arrangement as set forth in claim 9 wherein the circulating system circulates fluid between the reservoir and chambers formed above and below the tilt piston for accumulating particles formed either above or below the tilt piston into the cavity.

11. A position adjusting arrangement as set forth in claim 10 wherein the cavity is formed below an annular sealing ring positioned at the uppermost surface of the trim piston.

12. A position adjusting arrangement as set forth in claim 11 wherein the annular sealing ring has a lip formed at its upper edge held in sliding relation to the trim piston cylinder bore.

13. A position adjusting arrangement as set forth in claim 12 wherein the cavity extends around the circumference of the piston.

14. A position adjusting arrangement as set forth in claim 13 wherein the cavity comprises a plurality of circumferentially spaced recesses.

* * * * *